United States Patent [19]

Brown

[11] 4,248,547

[45] Feb. 3, 1981

[54] FENCE FOR ENCLOSING IMPURITIES FLOATING ON WATER

[76] Inventor: Norman D. Brown, Rt. 1, Box 10, Cold Spring, New York, N.Y. 10516

[21] Appl. No.: 938,468

[22] Filed: Aug. 31, 1978

[51] Int. Cl.[3] ..... E02B 15/04

[52] U.S. Cl. ..... 405/72; 405/67

[58] Field of Search ..... 405/26, 60, 63, 66, 405/72, 67

[56] References Cited

U.S. PATENT DOCUMENTS

| | | | |
|---|---|---|---|
| 3,613,376 | 10/1971 | Midby | 405/66 |
| 3,757,526 | 9/1973 | Larsson | 405/72 X |
| 3,775,982 | 12/1973 | Lamboley | 405/72 |
| 3,786,637 | 1/1974 | Muramatsu et al. | 405/72 |
| 3,800,542 | 4/1974 | Cerasari | 405/72 |
| 3,903,701 | 9/1975 | Gauch | 405/66 |

*Primary Examiner*—David H. Corbin

*Attorney, Agent, or Firm*—John Maier, III

[57] ABSTRACT

A fence for enclosing impurities floating on water having an elongated two-ply band of material with the two plies fused together in selected areas and with unfused sections extending between the two longitudinal edges and with unfused sections extending between the two side edges with weighted floating pickets placed within the longitudinally spaced openings.

8 Claims, 5 Drawing Figures

FENCE FOR ENCLOSING IMPURITIES FLOATING ON WATER

BACKGROUND OF THE INVENTION

This invention relates to a fence for enclosing impurities floating on water.

Patents which show various types of fences for enclosing impurities on water are as follows:

| Inventor | Patent Number | Country |
|---|---|---|
| Thune | 804,640 | England |
| Hof | 3,611,728 | U.S.A. |
| Midby | 3,613,376 | U.S.A. |
| Gauch | 3,903,701 | U.S.A. |
| Neal | 3,921,407 | U.S.A. |

In these patents, complicated techniques in one form or another are utilized for constructing the band, stiffening the band, weighting the band and floating the band. The floats, weights and supporting rods are contained in pockets applied to the outside of the band. Usually such pockets are sewn to the outside of the band. Occasionally, they are cemented to the band. In one example, a single ply of material for the band is folded over and stitched to form a space for floats and weights.

Due to the shape of the floats and weights and the manner of their attachment, namely location in a pocket, such booms are too bulky to roll. As a result, such booms are packaged in accordion fashion, folded back and forth, in ten or twelve foot segments.

Another problem with existing booms is the need to replace the entire boom when the band becomes severely damaged or too dirty for future use.

These and other various other problems were not satisfactorily resolved until the emergence of the instant invention.

SUMMARY OF THE INVENTION

In accordance with the present invention, there is provided an improved fence for enclosing impurities floating on water. An elongated band is formed from two plies of material which are fused together into one layer in selected areas by the application of elevated heat and pressure. When the two plies are placed together, a release material is located on specified areas between the two plies so that following the binding of the two plies together, pockets are formed between the two plies. A series of substantially parallel generally equally-spaced unfused sections for holding pickets are located between the upper edge and the lower edge of the band. Preferably, one or more unfused sections are located horizontally substantially at right angles to the vertically-located sections for holding ropes. The pickets are formed from a lighter than water material with rings attached at both ends for holding rope. A weight means is integral to each picket at one end of the picket. The material from which the plies are formed can be made in extensively long lengths. In this manner, band length is limited only by handling and storing capability.

The novel features which are considered as characteristics of the invention are set forth with particularity in the appended claims. The invention itself, however, as to its construction and obvious advantages, will be best understood from the following description and the specific embodiment when read with the accompanying drawings.

DETAILED DESCRIPTION

Figure 3:
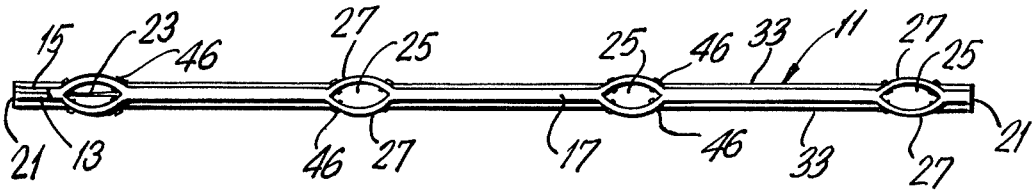
FIG. 3 is a view from above the elongated band of the fence.
Figure 1:
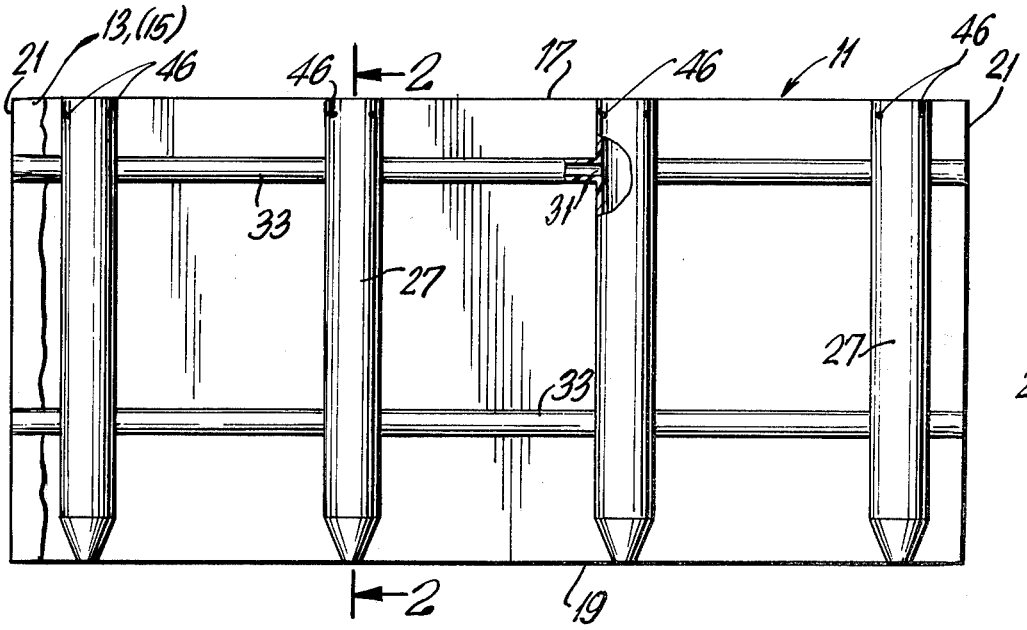
FIG. 1 is a side view of a portion of the elongated band of the fence partially broken away.
Figure 2:
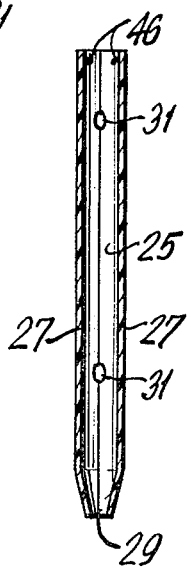
FIG. 2 is a cross section on line 2—2 of FIG. 1.

The same reference numerals are used throughout the drawings and specification to note a similar item of the invention.

The fence includes an elongated band 11 which is formed in two plies, namely a first ply 13 and a second ply 15. Additional plies could also be added. The band 11 is preferably made from a coated synthetic fabric which has selected fused and unfused areas, according to a designed pattern. The band has an upper edge 17, a lower edge 19 and two side edges 21. The upper edge 17 and the lower edge 19 are substantially parallel to one another. The two plies 13, 15 are fused together by placing the second ply 15 on top of the first ply 13. A cut out of release material 23, such as impregnated paper, is placed as an intermediate layer between the two plies 13, 15. The release material 23 may be formed in one sheet or from strips. If paper is used for the release material 23, it is impregnated to obtain a higher curing temperature or heat resistance than the product being cured. For such a purpose, a high temperature film such as tetrafluorethylene or fluorelastomer may also be used. Heat and pressure are then applied to the band 11 forming a bond between the two plies 13, 15 except in those areas where the release material 23 is located. By way of example, the band 11 of synthetic fabric could be impregnated with a neoprene compound and dried until the solvent content is reduced to 1%. The two plies 13, 15 of this coated synthetic fabric would be calendared together with the release material 23 between them. The two plies 13, 15 and the release material 23 are then cured under a pressure of 60 psi and 350 degree F for ten minutes.

In the production of the band 11, a synthetic fabric, such as a nylon fabric, is coated with a neoprene compound. If paper is used as the release material 23, it is cut to pattern and placed between the two plies 13, 15. The release material 23 may also be a powdered, granular or flake release agent such as talc or mica. With such powdered, granular or flake materials, a template (not shown) may be used to control the application of the agent. In drum curing, the two plies 13, 15 with the release material 23 between them is wrapped on a drum, under tension, then placed in an autoclave filled with steam at 60 psi. With press curing, the two plies 13, 15, with the release material 23 between them, are placed between two platens at 305 degrees Fahrenheit for ten minutes at a platen pressure of 500 psi. Whenever possible, the release material 23 is removed for further use. One advantage of using a powdered, granular or flaked substance as the release material 23, is to avoid removal of the release material 23 after final cure.

The two plies 13, 15 are formed into a single sheet except where the release material 23 was located. In this way, a series of vertical pockets 25, substantially evenly-spaced between the two sides 21, are thus formed, extending from the upper edge 17 to the lower edge 19. The vertical pockets 25 have substantially parallel sides 27 extending from the upper edge 17 almost to the lower edge 19, where each of the vertical pockets 25 is reduced to an opening 29. A series of horizontal pockets 31 are also formed by the release material 23 extending from one edge 21 to the other side edge 21. The horizontal pockets 31 have substantially parallel edges 33 extending all the way from one side to the other side. The horizontal pockets 31 are located substantially parallel to the upper edge 17 and the lower edge 19 and cross the vertical pockets 25 at substantially right angles.

Figures 4, 5:
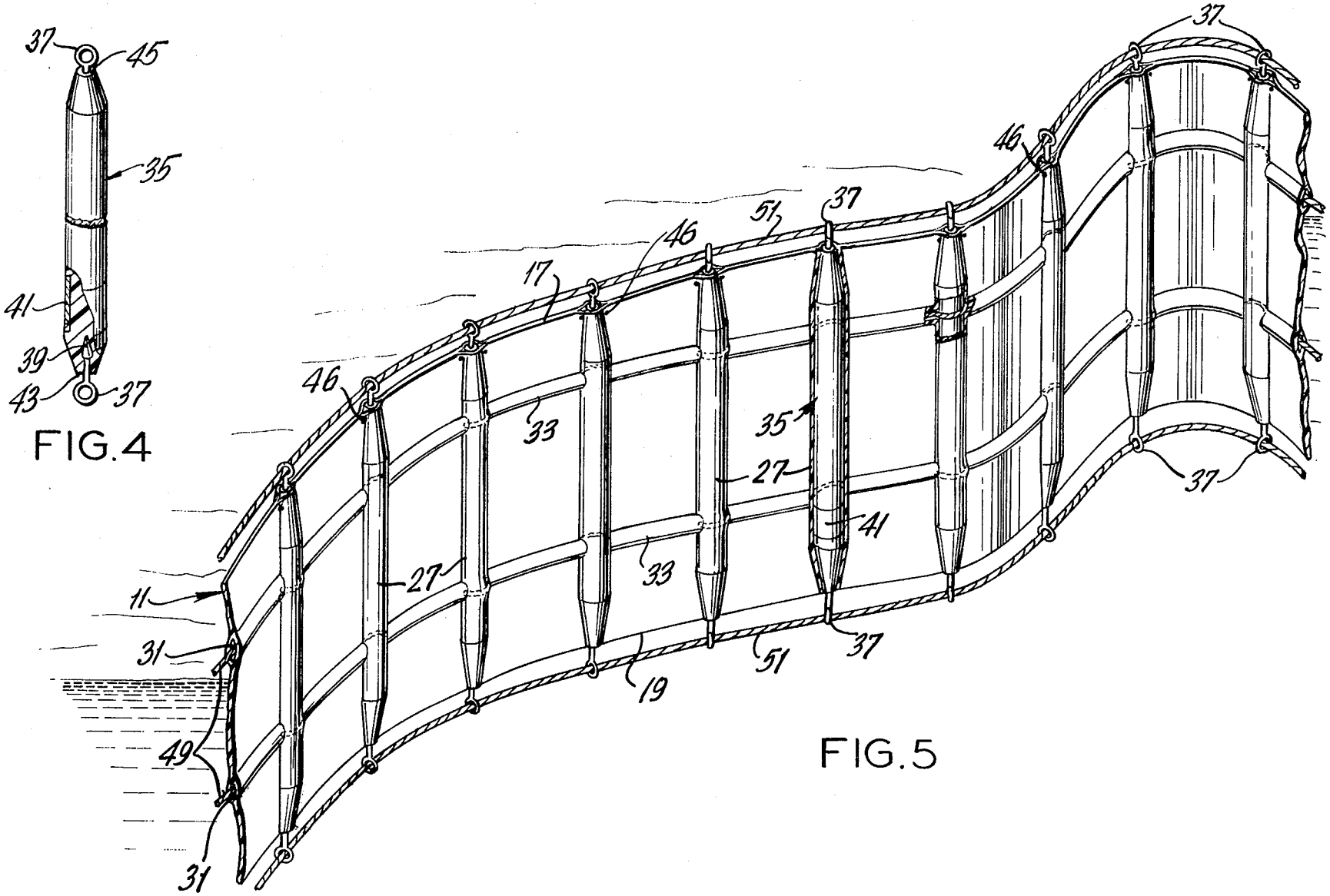
FIG. 4 is a view in perspective of a picket for insertion into the fence with the picket partially broken away.
FIG. 5 is a view in perspective of a portion of the fence floating in water.

Referring now to FIGS. 4 and 5, pickets 35 for insertion on the vertical pockets 25 are made from a material having a density lighter than water, preferably high-density closed-cell polyvinyl chloride. The pickets 35 are formed in a generally cylindrical shape. After the material is molded and before any curing is undertaken, a ring 37 mounted on a probe 39 is connected to both ends of the picket 35 by inserting a probe 39 with a ring 37 into both the lower end 43 and the upper end 45 of the picket 35. A heavy collar 41, having a density heavier than water, preferably made of lead, is slipped over the lower end 43 of the picket 35. The picket 35 is then cured by heating in an oven to produce a tough finish, a closed cellular structure and to secure the probes 39 firmly into the picket 35 and to lock the collar 41 into the picket 35. The oven cure increases the size of the molded preformed picket 35 by a proportion of two to one. In this way, the picket 35, each probe 39, and collar 41 are formed into one integral unit. As an alternative to the heavy collar 41, granular material could be inserted into the picket 35 before curing.

A picket 35 is placed in each vertical pocket 25 with the heavy collar 41 adjacent the reduced opening 29 and the lower edge 19. Each reduced opening 29 has a cross-sectional area smaller than the cross-sectional area of each picket 35. As a result of this reduction, the picket 35 cannot be pulled downwardly out of the band 11. Snaps 46 are installed on each side of the vertical pockets 25 at the top of the band 11. In this manner, the plies 13, 15 are held together preventing the pickets 35 from rising out of the band 11.

Ropes 49 may be strung through the horizontal pockets 31 and around the pickets 35 thereby providing horizontal tensile strength to the band 11.

Ropes 51 may be placed through each ring 37, both along the upper edge 17 and the lower edge 19. The use of ropes 51 in generally for easy handling in deploying and retrieving the fence.

Since the pockets are integral to the band 11, and there are no added pockets or hems and no hardware or fittings, the band 11 can be easily rolled up for storage and easily fed out for use. Since the plies 13, 15 can be obtained in substantial lengths, the length of a band 11 is limited only by its size and weight when rolled up.

The invention may be embodied in other specific forms without departing from the spirit or essential characteristics thereof. The present embodiments are therefore, to be considered in all aspects as illustrative and not restrictive. The scope of the invention being indicated by the appended claims rather than the foregoing description and all changes which come within the meaning and range of equivalency of the claims are therefore intended to be embraced therein.

I claim:

1. A fence for enclosing impurities floating on water, comprising:

an elongated band of flexible, impermeable material with an upper edge and a lower edge and two side edges, said elongated band being formed from two plies of the same material generally bonded together with the two plies free of one another in selected areas including vertical pockets, each vertical pocket having substantially parallel sides extending from the upper edge to adjacent the lower edge with tapered sides adjacent the lower edge to form an opening at the lower edge;

a plurality of pickets, each one of said pickets being located within a separate vertical pocket and extending at its ends substantially to the lower edge and the upper edge, each of said plurality of pickets being substantially formed from two basic components, one component formed from a material having a density lighter than water and the other component formed from a material having a density heavier than water, said heavy component being located adjacent the end of said picket near said lower edge, said opening at the lower edge being smaller than the cross-section of the pickets;

a plurality of rings, one ring mounted at each end of each of said plurality of pickets, each ring adjacent the lower edge extending slightly beyond the lower edge and each ring adjacent the upper edge extending slightly beyond the upper edge;

rope means extending through the plurality of rings; and fastening means for closing the vertical pockets at the upper edge to retain each picket within its respective vertical pocket.

2. A fence for enclosing impurities floating on water according to claim 1 wherein said selected areas further include a horizontal pocket extending from side to side of the elongated band substantially at right angles to the vertical pockets and located between the upper edge and the lower edge.

3. A fence for enclosing impurities floating on water, comprising:

an elongated band of flexible, impermeable material with an upper edge and a lower edge and two side edges, said elongated band being formed from two plies of the same material generally bonded together with the two plies free of one another in selected areas including vertical pockets extending from the upper edge to adjacent the lower edge with tapered sides adjacent the lower edge to form an opening at the lower edge and at least one horizontal pocket with substantially parallel edges extending from side to side of the elongated band substantially at right angles to the vertical pockets;

a plurality of pickets, each one of said pickets being located within a separate vertical pocket and being substantially formed from two basic components, one component formed from a material having a density lighter than water and the other component formed from a material having a density heavier than water, said heavy component being located adjacent the end of said picket near said lower edge, said opening at the lower edge being smaller than the cross-section of the pickets;

a plurality of rings, one ring mounted at each end of each of said plurality of pickets, each ring adjacent the lower edge extending slightly beyond the lower edge and each ring adjacent the upper edge extending slightly beyond the upper edge; and rope means extending through the plurality of rings and through the horizontal picket.

4. A fence for enclosing impurities floating on water, comprising:

an elongated band of flexible, impermeable material with an upper edge and a lower edge and two side edges, said elongated band being formed from two plies of the same material generally bonded together with the two plies free of one another in selected areas including vertical pockets extending from the upper edge to adjacent the lower edge with tapered sides adjacent the lower edge to form an opening at the lower edge and at least one horizontal pocket with substantially parallel edges extending from side to side of the elongated band substantially at right angles to the vertical pockets;

a plurality of pickets, each of said pickets being located within a separate vertical pocket and being substantially formed from two basic components, one component formed from a material having a density lighter than water and the other component formed from a material having a density heavier than water, said heavy component being located adjacent the end of said picket near said lower edge, said opening at the lower edge being smaller than the cross-section of the pickets;

a plurality of rings, one ring mounted at each end of each of said plurality of pickets, each ring adjacent the lower edge extending slightly beyond the lower edge and each ring adjacent the upper edge extending slightly beyond the upper edge;

rope means extending through the plurality of rings and through the horizontal pocket; and fastening means for closing the vertical pockets at the upper edge to retain each picket within its respective vertical pocket.

5. A fence for enclosing impurities floating on water according to claim 3 wherein said two plies forming the elongated band are each a synthetic fabric coated with an elastomeric compound.

6. A fence for enclosing impurities floating on water according to claim 3 wherein said two plies forming the elongated band are each a synthetic fabric coated with an polymeric compound.

7. A fence for enclosing impurities floating on water according to claim 3 wherein said material forming said pickets is high-density closed cell polyvinyl chloride.

8. A fence for enclosing impurities floating on water according to claim 7 wherein said heavy component is a lead collar integrated with said polyvinyl chloride.

* * * * *